US005324460A

United States Patent [19]

Briggs

[11] Patent Number: 5,324,460

[45] Date of Patent: Jun. 28, 1994

[54] METHOD OF MAKING A HELMET LINER

[75] Inventor: Adrian L. S. Briggs, Stevenage, England

[73] Assignee: Helmets Limited, Herts, England

[21] Appl. No.: 731,620

[22] Filed: Jul. 17, 1991

[30] Foreign Application Priority Data

Jul. 23, 1990 [GB] United Kingdom ..... 9016106

[51] Int. Cl.[5] ..... A42B 3/00; B29C 33/48

[52] U.S. Cl. ..... 264/45.2; 264/46.6; 264/222; 2/411; 2/414

[58] Field of Search ..... 2/410, 411, 412, 414, 2/413, 417, 192, 425; 36/55, 93, 119; 264/222, 45.2, 46.5, 45.4, 46.6

[56] References Cited

U.S. PATENT DOCUMENTS

| | | | |
|---|---|---|---|
| 3,726,620 | 4/1973 | Morton | 2/410 |
| 3,834,044 | 9/1974 | McAusland et al. . | |
| 3,876,746 | 4/1975 | Hanson . | |
| 3,956,773 | 5/1976 | Chisum . | |
| 4,001,894 | 1/1977 | Roques-Rogery . | |
| 4,044,399 | 8/1977 | Morton . | |
| 4,060,855 | 12/1977 | Rappleyea . | |
| 4,120,064 | 10/1978 | Salomon | 36/93 |
| 4,345,338 | 8/1982 | Frieder, Jr. et al. . | |
| 4,433,494 | 2/1984 | Courvoisier et al. | 36/119 |
| 4,809,379 | 3/1989 | Jungwirth | 36/93 |
| 4,837,884 | 6/1989 | Hilgarth | 36/93 |
| 5,067,257 | 11/1991 | Coomer | 36/93 |

FOREIGN PATENT DOCUMENTS

| | | | |
|---|---|---|---|
| 322230 | 5/1975 | Austria . | |
| 0004829 | 10/1979 | European Pat. Off. . | |
| 2106667 | 4/1972 | Fed. Rep. of Germany | 36/93 |
| 2456754 | 6/1975 | Fed. Rep. of Germany | 36/93 |
| 2602505 | 7/1977 | Fed. Rep. of Germany | 36/93 |
| 2749816 | 5/1979 | Fed. Rep. of Germany | 2/411 |
| 2204106 | 5/1974 | France . | |
| 2226128 | 11/1974 | France . | |
| 2243064 | 4/1975 | France . | |
| 87/01566 | 3/1987 | PCT Int'l Appl. . | |

*Primary Examiner*—Andrew M. Falik
*Assistant Examiner*—Michael A. Neas

[57] ABSTRACT

A method forms a helmet liner which during its formation is fitted to the head of the user, by forming an inflatable liner element of extensible sheet material approximately conforming to the shape of the interior surface of a helmet shell, providing the element with respective foam filling and vent passages, the vent passages serving to expel air from the liner as foam filling proceeds, mounting the liner element in the helmet on the head of the user, supplying foam to the foam filling passages to inflate the liner element, expel air therefrom and conform the element at an outer surface to the shape of the interior surface of the helmet shell and at an inner surface to the shape of the head of the user, allowing time for curing of the foam admitted to the liner element, and severing parts of the vent and foam filling passages projecting from the liner. The liner element can embrace a forehead portion only of the head of the user or a further element which embraces a rear part of the head can be added. In another form embodiment, the liner element may cover the crown, front and rear of the head of the user.

23 Claims, 5 Drawing Sheets

60
94
62
VII
VII
76
66
94

90
66
86
70
94
92
84
60
74
82
62
96
76
88
80
98

METHOD OF MAKING A HELMET LINER

BACKGROUND OF THE INVENTION

This invention relates to helmet liners and a method of making such liners which in their formation are fitted to the head of the user. In specialised helmets such as are employed, for example, by aircrew personnel the proper protection and comfort of the user dictates that the helmet is an accurate fit and that the closeness of the fit be accomplished by use of a shock absorbing liner which is tailored to the shape of the head of the user and to the interior of the helmet shell. References herein to the interior of the helmet shell are to be understood as referring to the inner surface of the shell or of a fixed impact absorbing lining material provided in the shell.

DESCRIPTION OF THE BACKGROUND ART

A first known method of fabricating such a fitted helmet liner employs a fabric spacer cap which is placed on the head of the helmet user and secured thereto by hook and pile tape. A release compound is applied to the upper surface of the spacer cap and a mould seal frame is then mounted on the cap and disposed in alignment with the location of the brow of the liner to be formed. A mould shell lined with a coating of release compound is next secured to the frame to form a liner cavity over that part of the head of the user to be occupied by the liner and the mould shell position on the frame is adjusted to seal the edge of the shell to the frame. A mixture, suitably of polyurethane foam forming chemicals is then supplied to the liner cavity to form the liner. After allowing about twenty minutes for foam curing to occur, the liner is removed by removing the mould shell, its frame and the spacer cap from the head of the user and thereafter dismantling the frame and shell to release the formed liner.

This known method of helmet shell liner fabrication is unsatisfactory inasmuch as the pouring of the foam forming chemicals is a hand mixing procedure which releases a substantial amount of vapour which is a health hazard. The process is overall lengthy and because it is carried out without using the helmet shell for which the liner is ultimately destined a high reject rate occurs in production because of the need later to get a precise fitting of the liner within the helmet shell and further because the polyurethane foam forming chemicals usually employed are sensitive to moisture and temperature which gives rise to a variable rate of foam formation.

A second known method involves the use of a fitting cap which is mounted on the head of the user. A number of layers of thermoplastic liner material shaped approximately to the head of the user are placed over the cap after heating thereof to plastic condition in an oven. A fitting shell is next placed over the layers of liner material and by means of a weighted ring across which are secured fabric straps which engage the fitting shell, the liner layers are compressed and formed into an integral liner by pulling the ring downwards around the user's head.

This fabrication method is also unsatisfactory because it requires an oven and that in turn requires the presence of such an oven at a large number of locations at each of which personnel qualified to make the liners have to be present. Also, as the liner is formed outside the helmet shell it is difficult later to fit the liner precisely to the helmet shell. Moreover, air is entrapped in the liner during formation thereof which, because of pressure variations in aircraft cabins in which helmets employing such liners are used, causes the fit of the helmet to be adversely affected.

SUMMARY OF THE INVENTION

It is accordingly an object of the present invention to provide an improved method of forming a helmet liner element which in the formation thereof is fitted to the head of the user. A further object is to provide such a method in which the liner element in the formation thereof is directly fitted both to the helmet shell and to the head of the user.

The present invention consists in the method of forming a helmet liner element which in the formation thereof is fitted to the part of the head of the user and which comprises the steps of:

(a) forming an inflatable liner element of extensible sheet material approximately conforming to the shape of the interior surface of a helmet shell, (b) providing said element with respective foam filling and vent means, said vent means serving to expel air from the liner as foam filling proceeds, (c) mounting said liner element in said helmet on the head of the user thereof, (d) supplying foam to said foam filling means to inflate said liner element, the admission of said foam causing expulsion of air from said element by way of said vent means and conforming the element at an outer surface thereof to the shape of the interior surface of the helmet shell and at an inner surface thereof to the shape of the head of the user, (e) allowing time for curing of said foam admitted to the liner element, (f) removing said shell and liner element from the head of the user, and (g) severing parts of said vent and foam filling means projecting from said liner.

In one form, the method of the invention includes forming said liner element as a front liner element to embrace a forehead portion of the user of the helmet.

In said one form, the method of the invention may also include forming said liner element as a rear liner element to embrace a rear portion of the head of the user of the helmet. Advantageously, the method further includes forming said rear liner element with a lower part which serves as a neck pad. Preferably, the method of the invention further includes providing said neck pad part of said rear liner element on the exterior thereof with a neck pad support in which an adjustable strap is mounted which is fixedly secured to the helmet shell at one end and adjustably secured to said shell at the other end thereof, and adjusting said strap after mounting of said helmet on the head of the user to cause engagement between said neck pad with said user prior to inflation with foam of said liner element.

In a further form the invention includes forming said liner element to extend over the crown front and rear of the helmet shell.

Suitably, said liner elements of the invention are each formed from outer and inner skins of sheet plastics material sealed along their respective marginal edges.

Advantageously said skins may be formed each by thermo forming, said outer skin being conformed to the interior of a helmet shell mould. Preferably the inner skin is conformed approximately to the shape of the head of the user of the helmet.

The invention also includes a helmet liner element characterised by an inner skin conformed to the head of a user of the helmet, an outer skin conformed to the shell of the helmet, said skins being mutually sealed at marginal edges thereof, and a filling of cured rapid cure foam between said skins.

In one form the liner element is adapted to embrace only a front part of the head of the user.

Suitably, a further liner element is provided which is adapted to embrace only a rear part of the head of the user.

Advantageously, said liner element is characterised in that said liner element is adapted further to embrace the neck of the user.

In another form the liner element is adapted to embrace the crown front and rear of the head of the user.

Further scope of applicability of the present invention will become apparent from the detailed description given hereinafter. However, it should be understood that the detailed description and specific examples, while indicating preferred embodiments of the invention, are given by way of illustration only, since various changes and modifcations within the spirit and scope of the invention will become apparent to those skilled in the art from this detailed description.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
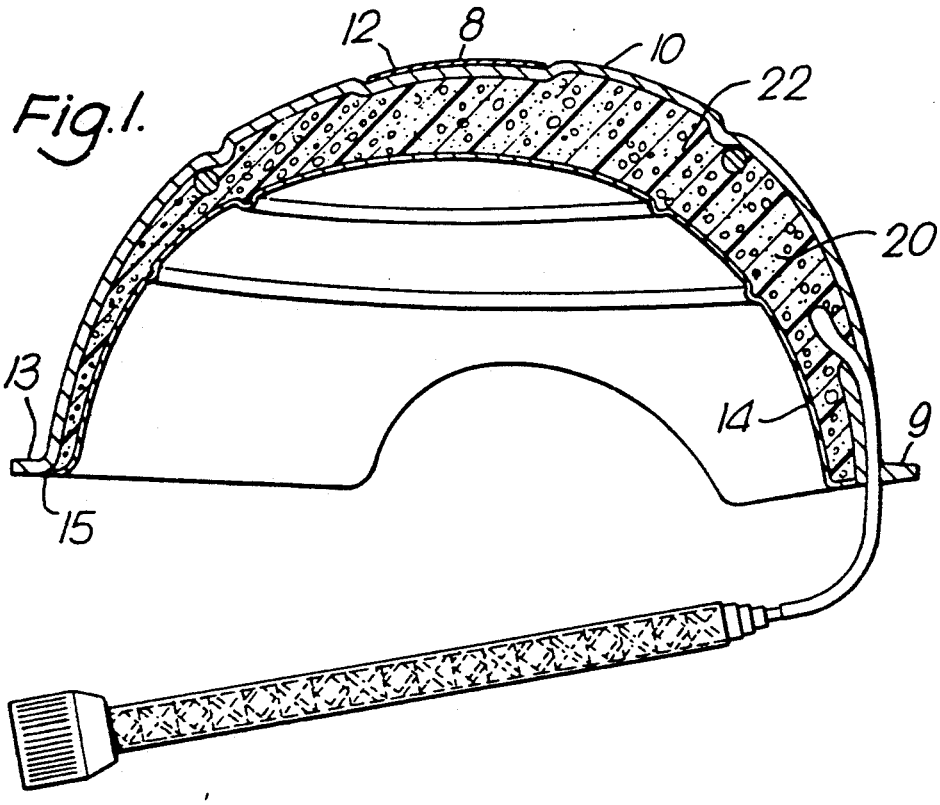
FIG. 1 is a sectional side elevation of a helmet liner of an aircrew helmet made in accordance with this invention.

Referring first ti FIG. 1, a helmet liner 10 for an aircrew helmet made in accordance with the present invention comprises an outer skin 12 formed from extensible foamed sheet plastics material, and an inner skin 14 of extensible foamed sheet plastics material, the skins 12 and 14 being sealed at their marginal edges 13 and 15 as, for example, by heat sealing or adhesive bonding. The skins are each formed in a known manner by thermo forming that is to say by providing a sheet of the material of the skin on a frame, heating the sheet to plasticise it, bringing a mould up to one surface of the sheet and applying vacuum to the mould interior to draw the sheet into the mould and conform it to the inner surface thereof. The mould form employed for the outer skin is hollow and corresponds with the interior shape of the helmet shell for which the liner 10 is destined and the mould employed for the inner skin corresponds very approximately with the shape of the head of the user of the helmet. Suitably, the material of the skins is polyethylene plastics. Also, the inner skin 14 may advantageously be formed with gussets (not shown) to increase its extensible capacity during injection and curing of the foam.

Between the skins 12 and 14 can be mounted, if desired, at the crown 8 of the liner and at the brow portion 9 thereof respective strips of skeletal foam such as is frequently used for filter material. These strips serve to maintain the spacing of the skins and thereby facilitate the filling of cavity 20 between the skins with rapid cure non-toxic foam 22 as hereinafter described and to provide reinforcement. The skeletal foam strips when employed are adhesively bonded to the interior of the outer skin, the material of which is stiffer than that of the inner skin, prior to sealing together of the edges of the skins.

Figure 2:
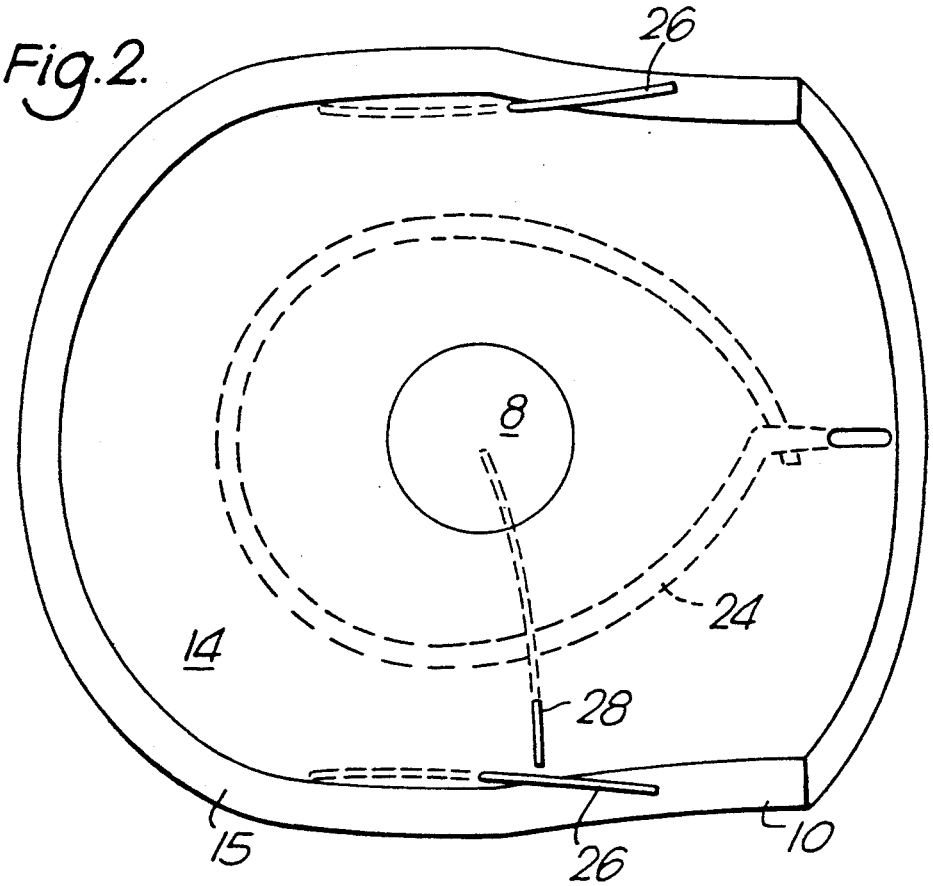
FIG. 2 is a top plan view of the helmet liner of FIG. 1 at a stage during its formation.

Referring now to FIG. 2, the sealing of the edges of the skins 12 and 14 is effected in a heat sealing tool (not shown) and, prior to heat sealing, foam filling tube 24 and air and surplus foam vent tubes 26 and 28 are disposed between the skins with outer ends thereof projecting outwardly from the skins. The inner ends of tubes 26 are located at opposite sides and the tubes extend along the inner surface of the skin 12 of the liner near the peripheral edge thereof whilst the inner end of tube 28 is secured to the inner surface and projects from the region of the crown 8 of the liner skin 12 through the skin 14 to the interior of the liner.

The foam filling tube 24 is, suitably, a silicone tube of 5 mm diameter and extends around the entire circumference of the inner surface of the liner skin 12 about midway between the crown and peripheral edge thereof. This tube is formed at 2.5 cm centered along its length with diametrically opposite perforations to allow a well distributed flow of foam chemicals into all parts of the liner interior.

The liner is placed in the helmet shell which is normally provided with a fixed impact absorbing lining and mounted therewith on the head of the user and held with the tubes 24, 26 and 28 projecting from the rim of the shell by supporting means in substantially immovable relationship relatively to the head of the user. Rapid cure non-toxic, silicone foam is now supplied to the tube 24, as hereinafter described, which fills the cavity 20 expelling air therefrom through tubes 26 and 28 and thereby extends the skins 12 and 14 forcing the skin 12 to stretch and conform closely to the interior shape of the helmet shell and the skin 14 to stretch and conform to the head of the user. The duration of the curing process is about five minutes but may be in the range 5 to 15 minutes.

After curing of the foam the liner/helmet shell assembly is removed from the head of the user and the liner is removed from the helmet shell. The ends of the tubes 24, 26 and 28 projecting from the liner are severed to complete the liner formation.

Figure 3:
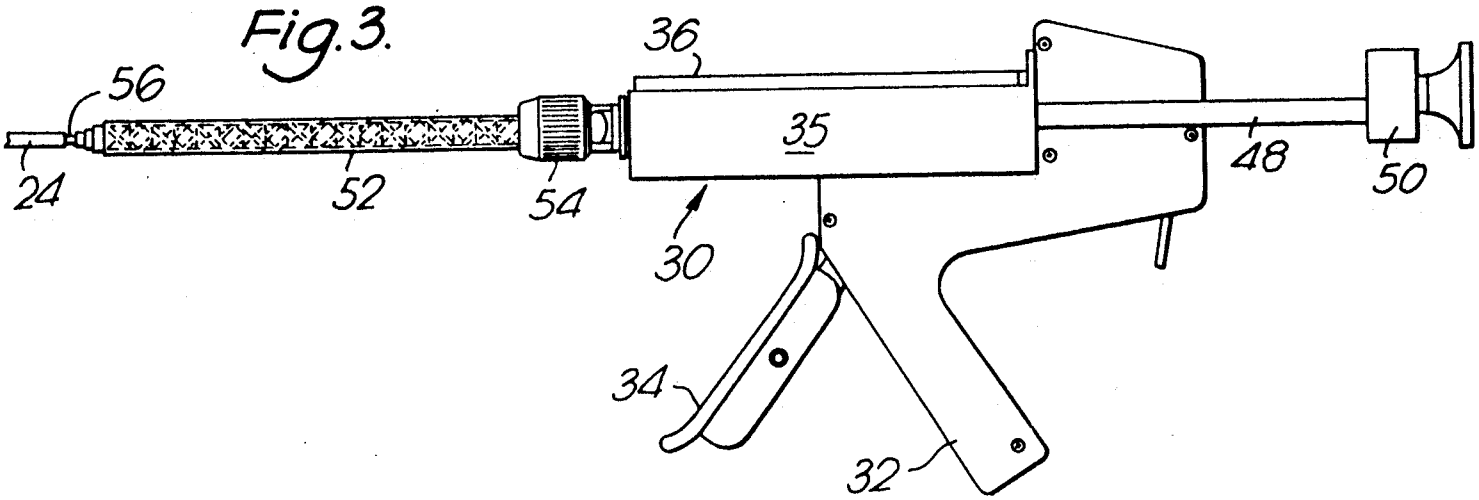
FIG. 3 is a side elevation of a foam filling gun employed in the method of the invention.
Figure 4:
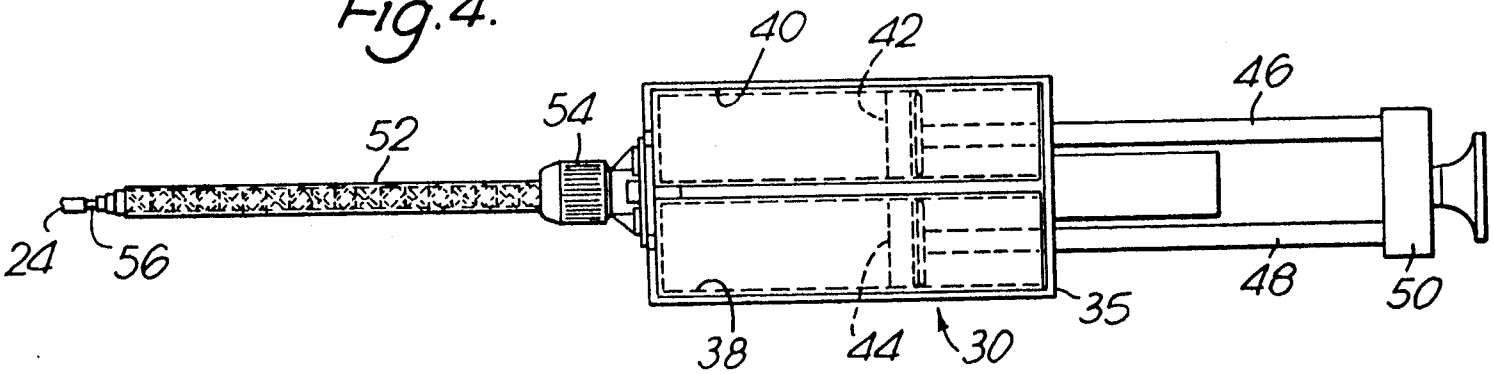
FIG. 4 is a plan view of the gun of FIG. 3.

FIGS. 3 and 4 illustrate a foam filling gun 30 which is generally of known form and comprises a pistol grip 32 and trigger 34. The grip and trigger extend from a breech housing 35 in which fits a cartridge 36 comprising a pair of parallel cylinders 38 and 40 containing silicone foam chemicals. Mounted in the breech housing is a pair of pistons 42 and 44 carried on parallel rods 46 and 48 connected at the ends remote from the pistons by a yoke 50. The trigger 34 and rods 46 and 48 are connected by mechanism (not shown) so that each actuation of the trigger advances the pistons from an initial withdrawn position in steps forwardly along the breech housing. When a cartridge is present, the pistons in their forward passage engage plungers in the respective cylinders and force the silicone foam chemicals into a static mixer tube 52 connected at its rear end by a union coupling 54 to the breech housing for receipt of the foam chemicals from the cylinders and at its forward end 56 to the tubes 24. The mixer tube 52 contains a series rotary of flow imparting helical vanes, suitably left and right handed vanes alternating from one to the next section of the series so that the chemicals are thoroughly mixed when they are discharged into the tube 24.

Referring now to FIGS. 5 to 9, a helmet impact absorbing lining 60 of rigid foam plastics is secured within a helmet shell (not shown). The lining 60 comprises a forehead or brow part 62 and a rear part 64 which extends over the top and rear of the head of the user. The parts 62 and 64 interlock at mating rear and front edge surfaces 66 and 68 thereof in dovetail fashion, the surface 66 providing the female and the surface 68 the male part of the dovetail.

Front and rear liner elements 70 and 72 line the forehead or brow part and rear part 62 and 64 of the impact absorbing lining 60 and are each filled, as hereinbefore described, with rapid cure non-toxic foam so as to fit the helmet to the head of the wearer.

Figure 5:
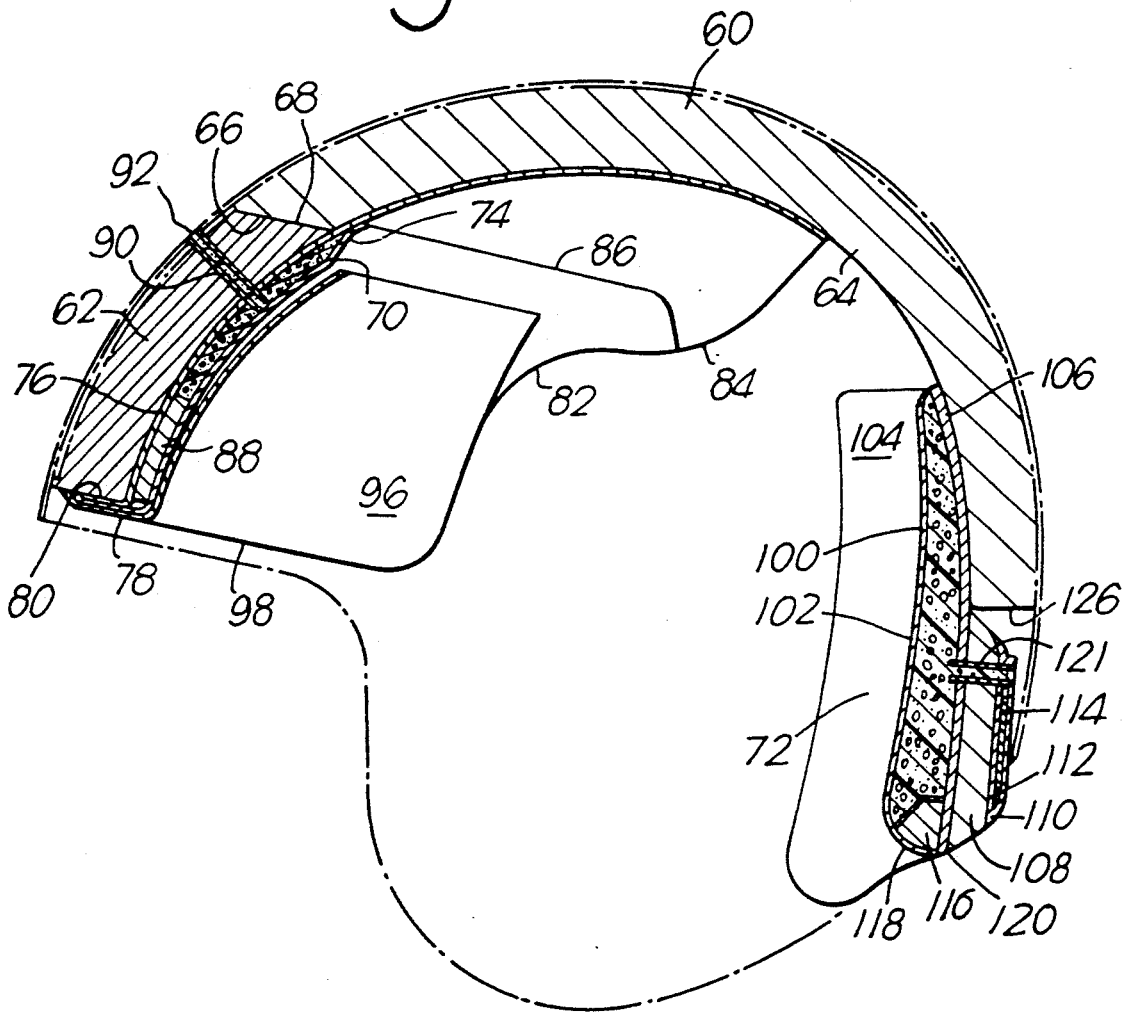
FIG. 5 is a sectional side elevation of a further embodiment of the invention illustrating a helmet impact absorbing lining fitted with liner elements.
Figure 6:
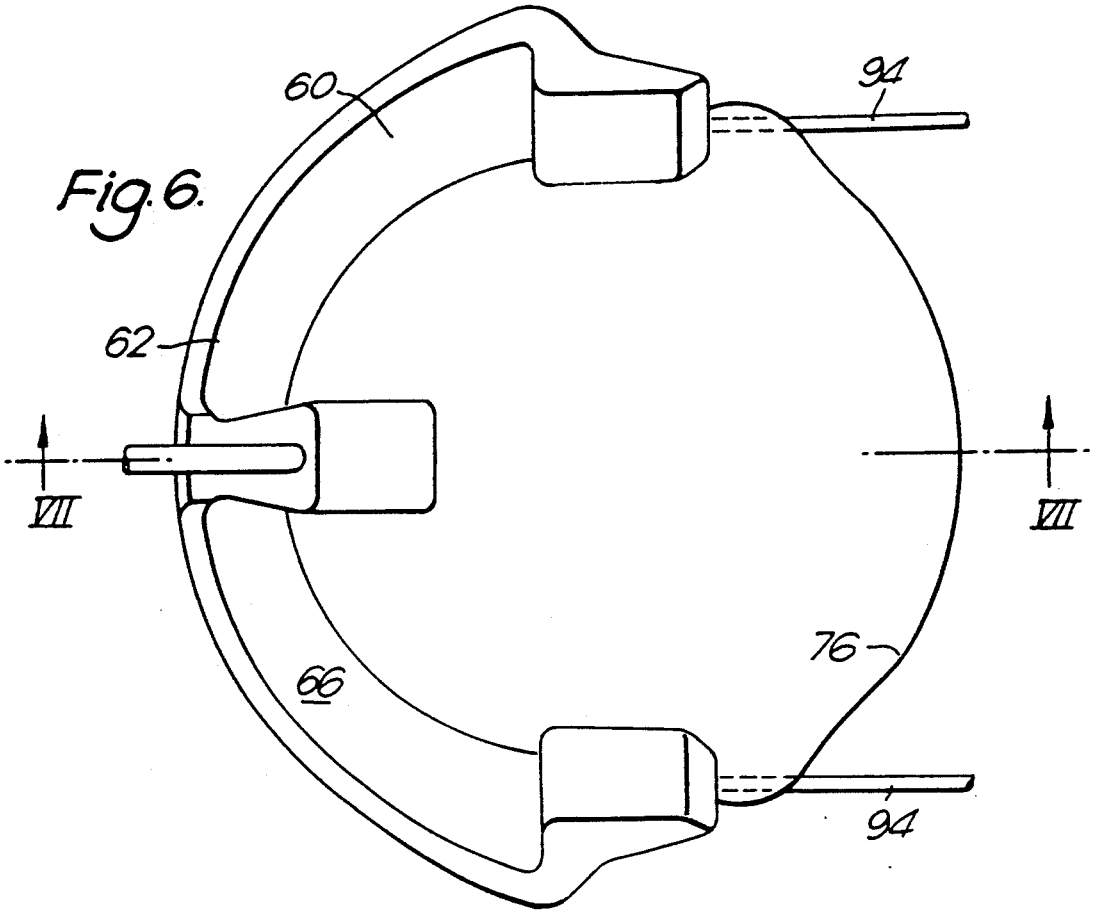
FIG. 6 is a top plan view of a forward part of the helmet impact absorbing lining of FIG. 5.
Figure 7:
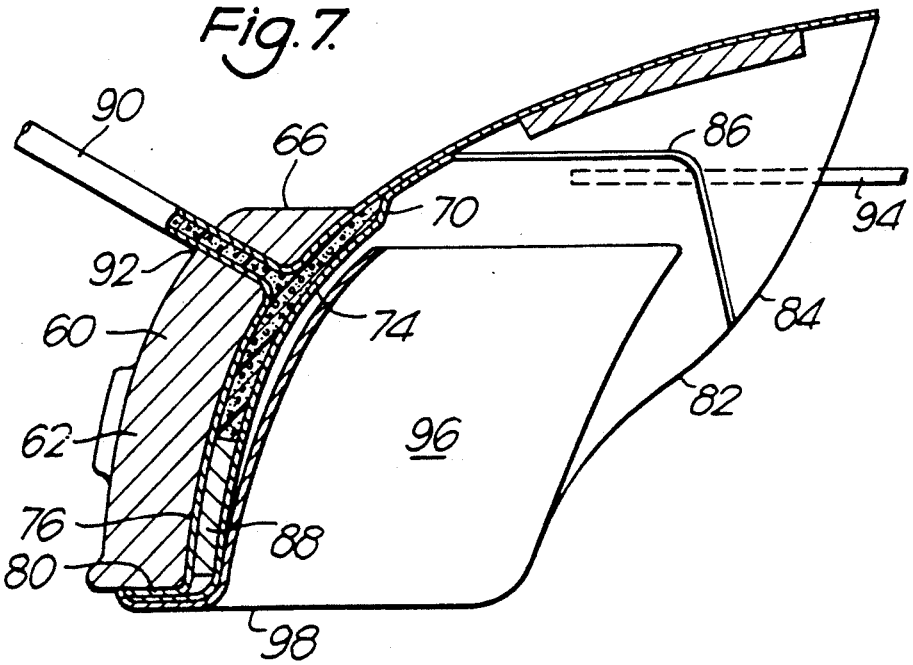
FIG. 7 is a sectional view on the line VII—VII of FIG. 6.
Figure 8:
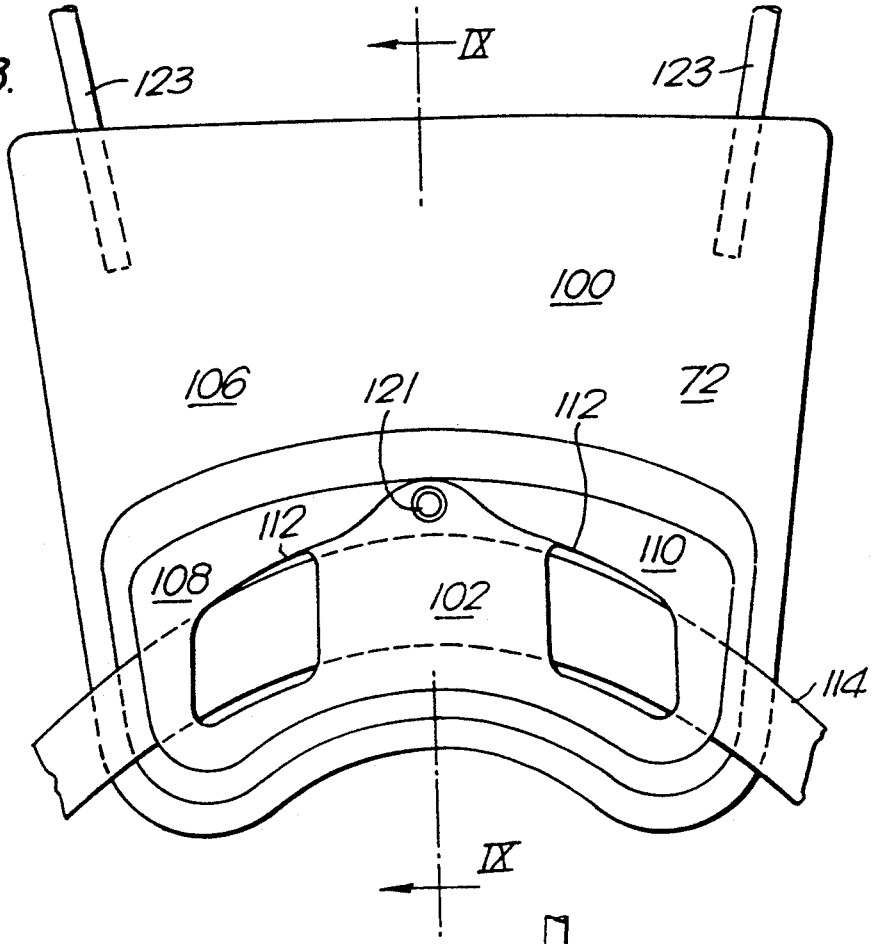
FIG. 8 is a rear elevation of a rear liner element of the helmet impact absorbing lining of FIG. 5.
Figure 9:
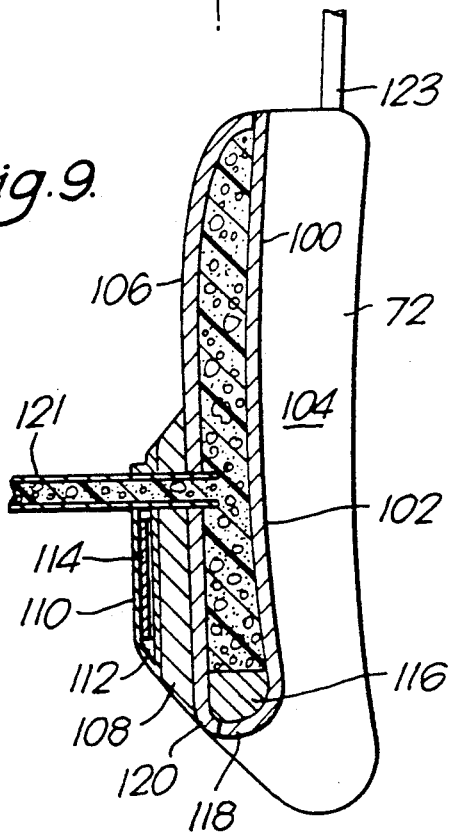
FIG. 9 is a sectional side view taken on the line IX—IX of FIG. 8.

The front liner element 70 comprises inner and outer skins 74 and 76 each formed from foamed plastic sheet but the inner skin comprises a more flexible material than the outer skin. As with the liner skins 14 and 12 described in relation to the embodiment of the invention described with reference to FIGS. 1 to 4, the inner and outer skins are preformed by a vacuum thermo foaming process, the outer skin 76 conforming to the helmet impact absorbing lining surface and the inner skin 74 conforming very approximately to the shape of the head of the wearer. The inner skin at its lower edge 78 is sealed to the lower edge 80 of the outer skin and is further sealed along its side edges 82 to the corresponding parts of side edges 84 of the outer skin and along its top edge 86 to the inner surface of the outer skin 76. As is seen in FIGS. 5 and 7 the outer skin 76 extends rearwards beyond the inner skin 74 to line the crown portion of the impact absorbing lining 60. Adjacent the edges 78 and 80 of the inner and outer skins is located between the skins, a strip of foam plastics 88 which acts as a spacer which assists proper filling of the cavity between the skins with the rapid cure non-toxic foam. A filling tube 90 opens into the cavity between the skins 74 and 76 and is secured to the outer skin. The filling tube extends through an aperture 92 in the impact absorption lining 60 and a corresponding aperture in the helmet shell. Vent tubes 94 are provided at respective opposite sides of the liner element 70 within the lining 60 through which air is expelled as filling of the element with the non-toxic foam proceeds. After filling with foam and curing of the foam, which as in the case of the first described embodiment of the invention is conducted with the helmet mounted on the head of the wearer so that the filled element 70 conforms to the lining 60 at its outer skin and to the wearer's head at its inner skin, the ends of the filling and vent tubes which project, in the case of the vent tubes, beyond the periphery of the element 70 and, in the case of the filling tube, outside the shell, are severed.

A leather comfort flap 96 is secured at its lower edge 98 to the sealed edges 78 and 80 of the inner and outer skins of the element 70 and also to the side edges 82 and 84 of the skins. The flap overlies the inner skin 74 so that the element 70 is disposed, during inflation thereof and subsequent use of the helmet, between the brow of the wearer and the lining 60.

The rear liner element 72 serves in its upper part 100 as a liner element and in its lower part 102 as a neck pad. The element comprises an inner skin 104 of foamed plastics material and an outer skin 106 which is thicker than the inner skin and also formed of foamed plastics material to the exterior of which is secured a neck pad support 108. The neck pad support includes a plate 110 secured to a pad of foamed plastics 111 at its rear surface which is formed with laterally spaced slots 112 through which a strap 114 is threaded. One end of the strap is fixedly secured to the helmet shell whilst the opposite end thereof is attached to a cord which is passed through a small hole in the helmet shell where it is secured by an adjustment clamp. The skins of the element 70 have a spacer 116 of U-shaped form disposed therebetween which extends along the bottom edges 118 and 120 and of the skins 104 and 106 and along the opposite side edges of the skins.

The assembly of the liner element 72 is effected by placing in a mould the preformed inner skin 104, locating the spacer 116 thereon and then placing a temporary spacer on the inner skin and locating the outer skin 106 on the spacer 116 and temporary spacer. The neck pad support 108 and plate 109 are then placed on the outer skin 106 to complete the assembly. A rubber cover is then located to close the mould and a vacuum is drawing within the mould. In this way, engagement under pressure is effected between the skins and the spacer 116. Heat is then applied through the rubber cover of the mould which causes the skins to bond to the spacer 116 and the neck pad support to bond to the outer skin 106. The mould is next opened and the temporary spacer is removed. The top facing edges of the skins are then heat sealed, after introducing vent tubes at opposite ends thereof, to form a closed cavity between the skins. A non-toxic foam filling tube 121 is introduced into rear skin 106 and vent tubes 123 open into the liner cavity.

The strap 114 is next fitted to the plate 110 by threading it through the slots 112. To form the liner element 72 the helmet is engaged on the head of the wearer with the assembly of the outer and inner skins 106 and 104 located with a top edge of the neck support 108 adjacent a rear bottom edge 126 of the impact absorbing lining 60. The string on the end of the strap 114 is drawn through the shell until a comfortable pressure exists between the element 72 and the neck and back of the head to the helmet wearer whereupon the string is clamped at the outside of the shell. Non-toxic silicone foam is then supplied to the cavity between the skins as previously described and when filled a period of 5 to 15 minutes is allowed for the foam to cure before the helmet is removed from the head of the wearer. After such removal, the projecting ends of the vent tubes and filling tube are severed.

The liner element 70 and 72 are separately formed one at a time in either order and prior to formation a pad 128 of foamed plastics which is self-adhesive on one side thereof is placed in a forward part of the crown of the helmet. This pad will usually comprise two or more layers of the material described to give an overall thickness such that the pad engages the head of the wearer.

The embodiment of the invention described with reference to FIGS. 5 to 9 is the preferred form as it enables more accurate fitting of the liner elements to the head of the user.

Accordingly, the method of the invention provides a rapid, safe, convenient and clean process for forming a helmet shell liner element or shell liner elements which are fitted with accuracy both to the interior of the helmet shell and to the head of the user. In the performance of the invention, the release of fumes into the atmosphere as, therefore, any health hazard attributable to contact with or inhalation of such fumes, is minimised. This hazard is further diminished by the use of non-toxic silicone foam. The need for a plasticising oven and for highly trained process operators is also eliminated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method of forming a helmet liner element which in the formation thereof is fitted to part of the head of the user and which comprises the steps of:

(a) forming an inflatable inner element of extensible sheet material approximately conforming to the shape of the interior surface of a helmet shell, (b) providing said element with respective foam filling and vent means, said vent means serving to expel air from the liner as foam filling proceeds, (c) mounting said liner element in said helmet on the head of the user thereof, (d) supplying foam to said foam filling means to inflate said liner element, the admission of said foam causing expulsion of air from said element by way of said vent means and confirming the element at an outer surface thereof to the shape of the interior surface of the helmet shell and at an inner surface thereof to the shape of the head of the user, (e) allowing time for curing of said foam admitted to the liner element, (f) removing said shell and liner element from the head of the user, (g) severing parts of said vent and foam filling means projecting from said liner, (h) forming said iner element as a rear liner element to embrace a rear portion of the head of the user of the helmet, said rear liner element having a lower part which serves as a neck pad, (i) providing said neck pad of said rear liner element on the exterior thereof with a neck pad support in which an adjustable strap is mounted which is fixedly secured to the helmet shell at one end and adjustably secured to said shell at the other end thereof, and (j) adjusting said strap after mounting of said helmet on the head of the user to cause engagement between said neck pad with said user prior to inflation with foam of said liner element.

2. The method of forming a helmet liner element which in the formation thereof is fitted to part of the head of the user and which comprises the steps of:

(a) forming an inflatable liner element having an inner skin of extendible sheet material and an outer skin of extensible sheet material, said outer skin approximately conforming to the shape of the interior surface of a helmet shell, (b) forming said outer skin so that the outer skin extends over a forehead portion and a forward part of the crown of the head of the user, forming said inner skin to extend over said forehead portion of the user and sealing said inner skin at edges thereof to the part of the outer skin which extends over the forehead portion of the user, (c) providing said element with respective foam filling and vent means, said vent means serving to expel air from the liner as foam filling proceeds, (d) mounting said liner element in said helmet on the head of the user thereof, (e) supplying foam to said foam filling means to inflate said liner element, the admission of said foam causing expulsion of air from said element by way of said vent means and conforming said outer skin of the element to the shape of the interior surface of the helmet shell and conforming said inner skin of the element of the shape of the head of the user, (f) allowing time for curing of said foam admitted to the liner element, (g) removing said shell and liner element from the head of the user, and (h) severing parts of said vent and foam filling means projecting from said inner.

3. The method claimed in claim 2, further comprising the step of positioning spacer means within said liner element to facilitate foam filling of said element.

4. The method of claim in claim 3, further comprising the step of forming said spacer means as a strip of foam plastics material.

5. The method of claimed in claim 2, comprising the step of positioning a pad in the crown of said helmet formed by at least one layer of one-sided self-adhesive foam plastics material.

6. The method of claim 2, comprising the step of forming said skins from foamed plastics material.

7. The method of claim in claim 2 comprising the step of forming said liner element as a rear liner element to embrace a rear portion of the head of the user of the helmet.

8. The method of claim in claim 7 comprising the step of positioning spacer means within said rear liner element to facilitate foam filling thereof.

9. The method of claimed in claim 2 comprising the step of forming said liner element to extend over the crown, front and rear of the helmet shell.

10. The method claimed in claim 9, comprising the step of forming said liner element from the outer and inner skins being of sheet plastics material sealed along their respective marginal edges.

11. The method claimed in claim 10 comprising the step of mounting a spacer means at a selected location between said skins prior to sealing said skins along their respective marginal edges.

12. The method claimed in claim 11, comprising the step of positioning two spacer means respectively along a brow portion and at or adjacent the crown of the skins.

13. The method claimed in claim 9, comprising the step of extending a foam filling tube within the liner spaced from the crown and periphery thereof around substantially the full circumference of the liner element.

14. The method claimed in claim 10 comprising the steps of forming said outer skin from foamed plastics material in sheet form and forming said outer skin from stiffer sheet plastics material than said inner skin.

15. The method claimed in claim 10, comprising the step of forming said skins each by thermo forming, and conforming said outer skin to the interior of a helmet shell mould.

16. The method claimed in claim 15 comprising the step of thermo forming said inner skin to conform approximately to the shape of the head of the user of the helmet.

17. The method of forming a helmet liner element which in the formation thereof is fitted to part of the head of the user and which comprises the steps of:

(a) forming an inflatable liner element having an inner skin of extendible sheet material and an outer skin of extensible sheet material, said outer skin approximately conforming to the shape of the interior surface of a helmet shell, said helmet shell being fitted with an impact absorption lining, (b) forming aligned apertures in said impact absorption lining and said helmet shell, (c) providing said liner element with a foam filler tube which extends through said aligned apertures, (d) providing said element with vent means, said vent means serving to expel air from the liner as foam filling proceeds, (e) mounting said liner element in said helmet on the head of the user thereof, (f) supplying foam to said foam filler tube to inflate said liner element, an admission of said foam causing expulsion of air from said element by way of said vent means and conforming said outer skin of the element to the shape of the interior surface of the helmet shell and conforming said inner skin of the element to the shape of the head of the user, (g) allowing time for curing of said foam admitted to the liner element, (h) removing said shell and liner element from the head of the user, and (i) severing parts of said vent means and foam filler tube projecting from said liner.

18. The method of forming a helmet liner element which in the formation thereof is fitted to part of the head of the user and which comprises the steps of:

(a) forming an inflatable liner element having an inner skin or extendible sheet plastics material and an outer skin of extensible sheet plastics material, said outer skin being stiffer the said inner skin and said outer skin approximately conforming to the shape of the interior surface of a helmet shell, (b) providing said element with respect foam filling and vent means, said vent means serving to expel air from the liner as foam filling proceeds, (c) mounting said liner element in said helmet on the head of the user thereof, (d) supplying foam to said foam filling means to inflate said liner element, the admission of said foam causing expulsion of air from said element by way of said vent means and conforming said outer skin of the element to the shape of the interior surface of the helmet shell and conforming and said inner skin of the element to the shape of the head of the user, (e) allowing time for curing of said foam admitted to the liner element, (f) removing said shell and liner element from the head of the user, and (g) severing parts of said vent and foam filling means projecting from said liner.

19. The method claim in claim 18, comprising the step of positioning a pad in the crown of said helmet formed by at least one layer of one-side self-adhesive foam plastics material.

20. The method of claim in claim 18 comprising the step of forming said rear liner element with a lower part which serves as a neck pad.

21. The method of claim 18 comprising of step of forming said skins of foamed plastics material.

22. The method of forming a helmet liner element which in the formation thereof is fitted to part of the head of the user and which comprises the steps of:

(a) forming an inflatable liner element having an inner skin of extendible sheet material and an outer skin of extensible sheet material said outer skin approximately conforming to the shape of the interior surface of a helmet shell, (b) forming said outer skin so that the outer skin extends over a forehead portion of the user, forming said inner skin to extend over said forehead portion of the user and sealing said inner skin at edges thereof to the part of the outer skin which extends over the forehead portion of the user, (c) securing a comfort flap at an edge thereof to a front part of the helmet rim, the comfort flap in use being disposed between the forehead of the helmet user and the front liner element, (d) providing said element with respective foam filling and vent means, said vent means serving to expel air from the liner as foam filling proceeds, (e) mounting said liner element in said helmet on the head of the user thereof, (f) supplying foam to said foam filling means to inflate said liner element, the admission of said foam causing expulsion of air from said element by way of said vent means and forming said outer skin of the element to the shape of the interior surface of the helmet shell and con forming said inner skin of the element to the shape of the head of the user.

(g) allowing time for curing of said foam admitted to the liner element, (h) removing said shell and liner element from the head of the user, and (i) severing parts of said vent and foam filling means projecting from said liner.

23. The method of forming a helmet liner element which in formation thereof is fitted to part of the head of the user and which comprises the steps of:

(a) forming an inflatable liner element to extend over the crown, front and rear of a helmet shell, said liner element having an inner skin of extendible sheet material and an outer skin of extensible sheet material, said outer skin approximately conforming to the shape of the interior surface of a helmet shell, (b) extending a foam filling tube within the iner spaced from the crown and periphery thereof around substantially the full circumference of the liner element, (c) providing said liner element with vent means, said vent means serving to expel air from the liner as foam filling proceeds, (d) mounting said liner element in said helmet on the head of the user thereof, (e) supplying foam to said foam filling means to inflate said liner element, the admission of said foam causing expulsion of air from said element by way of said vent means and conforming said outer skin of the element to the shape of the interior surface of the helmet shell and conforming said inner skin of the element to the shape of the head of the user, (f) allowing time for curing of said foam admitted to the liner element, (g) removing said shell and liner element from the head of the user, and (h) severing parts of said vent means and foam filler tube projecting from said liner.

* * * * *